US010410593B2

(12) United States Patent
Kim et al.

(10) Patent No.: US 10,410,593 B2
(45) Date of Patent: Sep. 10, 2019

(54) DISPLAY PANEL DRIVING APPARATUS AND DISPLAY APPARATUS HAVING THE SAME

(71) Applicant: SAMSUNG DISPLAY CO., LTD., Yongin-si, Gyeonggi-Do (KR)

(72) Inventors: Jinwoo Kim, Hwaseong-si (KR); Byeong-Doo Kang, Cheonan-si (KR); Jong-Hwa Kim, Seoul (KR); Jongman Bae, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/467,706

(22) Filed: Mar. 23, 2017

(65) Prior Publication Data

US 2017/0278471 A1 Sep. 28, 2017

(30) Foreign Application Priority Data

Mar. 25, 2016 (KR) ..... 10-2016-0035952

(51) Int. Cl.
*G09G 3/36* (2006.01)

(52) U.S. Cl.
CPC ..... *G09G 3/3648* (2013.01); *G09G 2330/02* (2013.01)

(58) Field of Classification Search
CPC ..... G09G 3/3685
USPC ..... 345/99–100
See application file for complete search history.

(56) References Cited

U.S. PATENT DOCUMENTS 7,450,098 B2 * 11/2008 Lee ..... G09G 3/3688 345/100
2005/0057482 A1 * 3/2005 Youngblood ..... G09G 3/3688 345/100
2010/0156944 A1 * 6/2010 Haupt ..... G09G 3/3688 345/690
2012/0120067 A1 * 5/2012 Kim ..... G02B 27/2264 345/419

FOREIGN PATENT DOCUMENTS

KR 1020040058513 7/2004
KR 1020090093180 9/2009

* cited by examiner

*Primary Examiner* — Roy P Rabindranath
(74) *Attorney, Agent, or Firm* — F. Chau & Associates, LLC

(57) ABSTRACT

A display panel driving apparatus includes a data driver, a gate driver, an extra resistance part through which a constant current passes, and a circuit configured to generate a first gamma voltage, and output a first extra gamma voltage indirectly to the data driver through the extra resistance part. The data driver is configured to generate a data signal based on the first gamma voltage and output the data signal to a data line of a display panel. The gate driver is configured to output a gate signal to a gate line of the display panel.

16 Claims, 10 Drawing Sheets

DISPLAY PANEL DRIVING APPARATUS AND DISPLAY APPARATUS HAVING THE SAME

CROSS-REFERENCE TO RELATED APPLICATIONS

This application claims priority under 35 U.S.C. § 119 to Korean Patent Application No. 10-2016-0035952, filed on Mar. 25, 2016 in the Korean Intellectual Property Office (KIPO), the disclosure of which is incorporated by reference in its entirety herein.

BACKGROUND

1. Technical Field

Exemplary embodiments of the present inventive concept relate to an image display, and more particularly to a display panel driving apparatus and a display apparatus having the display panel driving apparatus.

2. Discussion of Related Art

A display apparatus includes a display panel and a display panel driving apparatus. The display panel includes a gate line, a data line and a pixel. The display panel driving apparatus includes a gate driving part, a data driving part and a timing controlling part. The gate driving part outputs a gate signal to the gate line of the display panel. The data driving part outputs a data signal to the data line of the display panel. The data driving part generates the data signal using a gamma voltage.

SUMMARY OF THE INVENTIVE CONCEPT

At least one exemplary embodiment of the present inventive concept provides a display panel driving apparatus capable of improving display quality of a display apparatus.

At least one exemplary embodiment of the present inventive concept also provides a display apparatus having the above-mentioned display panel driving apparatus.

According to an exemplary embodiment of the present inventive concept, a display panel driving apparatus includes a data driver, a gate driver, an extra resistance part through which a constant current passes, and a circuit configured to generate a first gamma voltage, and output a first extra gamma voltage indirectly to the data driver through the extra resistance part. The data driver is configured to generate a data signal based on the first gamma voltage and output the data signal to a data line of a display panel. The gate driver is configured to output a gate signal to a gate line of the display panel.

In an exemplary embodiment, the circuit outputs first to N-th gamma voltages including the first gamma voltage directly to the data driver, and a second extra gamma voltage indirectly to the data driver, where N is a natural number>=two.

In an exemplary embodiment, the first to N-th gamma voltages sequentially decrease.

In an exemplary embodiment, the first to N-th gamma voltages linearly decrease.

In an exemplary embodiment, the first extra gamma voltage is greater than the first gamma voltage.

In an exemplary embodiment, the second extra gamma voltage is less than the second gamma voltage.

In an exemplary embodiment, the extra resistance part includes a first extra resistor and a second extra resistor. The first extra resistor may be electrically connected between a first extra gamma voltage output terminal outputting the first extra gamma voltage, and a first gamma voltage output terminal outputting the first gamma voltage. The second extra resistor may be electrically connected between a second extra gamma voltage output terminal outputting the second extra gamma voltage, and an N-th gamma voltage output terminal outputting the N-th gamma voltage.

In an exemplary embodiment, the data driver includes a resistor string including a plurality of resistors receiving the first to N-th gamma voltages.

In an exemplary embodiment, the constant current sequentially passes through the first extra gamma voltage output terminal, the first extra resistor, the resistor string, the second extra resistor and the second extra gamma voltage output terminal.

In an exemplary embodiment, the resistances of each of the resistors included in the resistor string are the same.

In an exemplary embodiment, the first extra gamma voltage is calculated by EGMA1=GMA1+(GMA1−GMAN)/(N−1)*(PR1+ER1)/R, where EGMA1 is the first extra gamma voltage, GMA1 is the first gamma voltage, GMAN is the N-th gamma voltage, N is the number of the gamma voltages, PR1 is a resistance of a first path resistor between the first extra gamma voltage output terminal and the first extra resistor, ER1 is a resistance of the first extra resistor, and R is a resistance of one among the resistors in the resistor string.

In an exemplary embodiment, the second extra gamma voltage is calculated by EGMA2=GMAN−(GMA1−GMAN)/(N−1)*(PR2+ER2)/R, where EGMA2 is the second extra gamma voltage, GMAN is the N-th gamma voltage, GMA1 is the first gamma voltage, N is the number of the gamma voltages, PR2 is a resistance of a second path resistor between the second extra gamma voltage output terminal and the second extra resistor, ER2 is a resistance of the second extra resistor, and R is a resistance of one among resistors in the resistor string.

In an exemplary embodiment, a resistance of the first extra resistor, a resistance of the second extra resistor, and resistances of each of the resistors in the resistor string are the same.

In an exemplary embodiment, the data driver includes a first data driving circuit adjacent to one side of the data line and configured to output the data signal to the one side of the data line, and a second data driving circuit adjacent to another side opposite to the one side of the data line and configured to output the data signal to the another side of the data line.

According to an exemplary embodiment of the present inventive concept, a display apparatus includes a display panel configured to display an image and the above-described display panel driving apparatus.

According to an exemplary embodiment of the present inventive concept, a display panel driving apparatus includes a circuit configured to output a first gamma voltage through a first terminal, output a second gamma voltage through a second terminal, and output a plurality of third gamma voltages through signal lines, respectively, a first resistor connecting the first terminal to a first signal line among the signal lines, a second resistor connecting the second terminal to a last signal line among the signal lines, and a data driver configured to generate a data signal based on at least one of the third gamma voltages and output the data signal to a data line of a display panel.

In an embodiment, the display panel driving apparatus includes a resistor string connecting the signal lines together.

In an embodiment, the first gamma voltage is greater than the third gamma voltage output through the first signal line.

In an embodiment, the second gamma voltage is less than the third gamma voltage output through the last signal line.

According to an exemplary embodiment of the present inventive concept, a display apparatus includes a display panel configured to display an image and the above-described display panel driving apparatus.

According to at least one embodiment of the present inventive concept, a color difference between areas of a display panel may be reduced. Thus, display quality of a display apparatus may be improved.

BRIEF DESCRIPTION OF THE DRAWINGS

The present inventive concept will become more apparent by describing in detail exemplary embodiments thereof with reference to the accompanying drawings, in which.

DETAILED DESCRIPTION OF THE EXEMPLARY EMBODIMENTS

Figure 1:
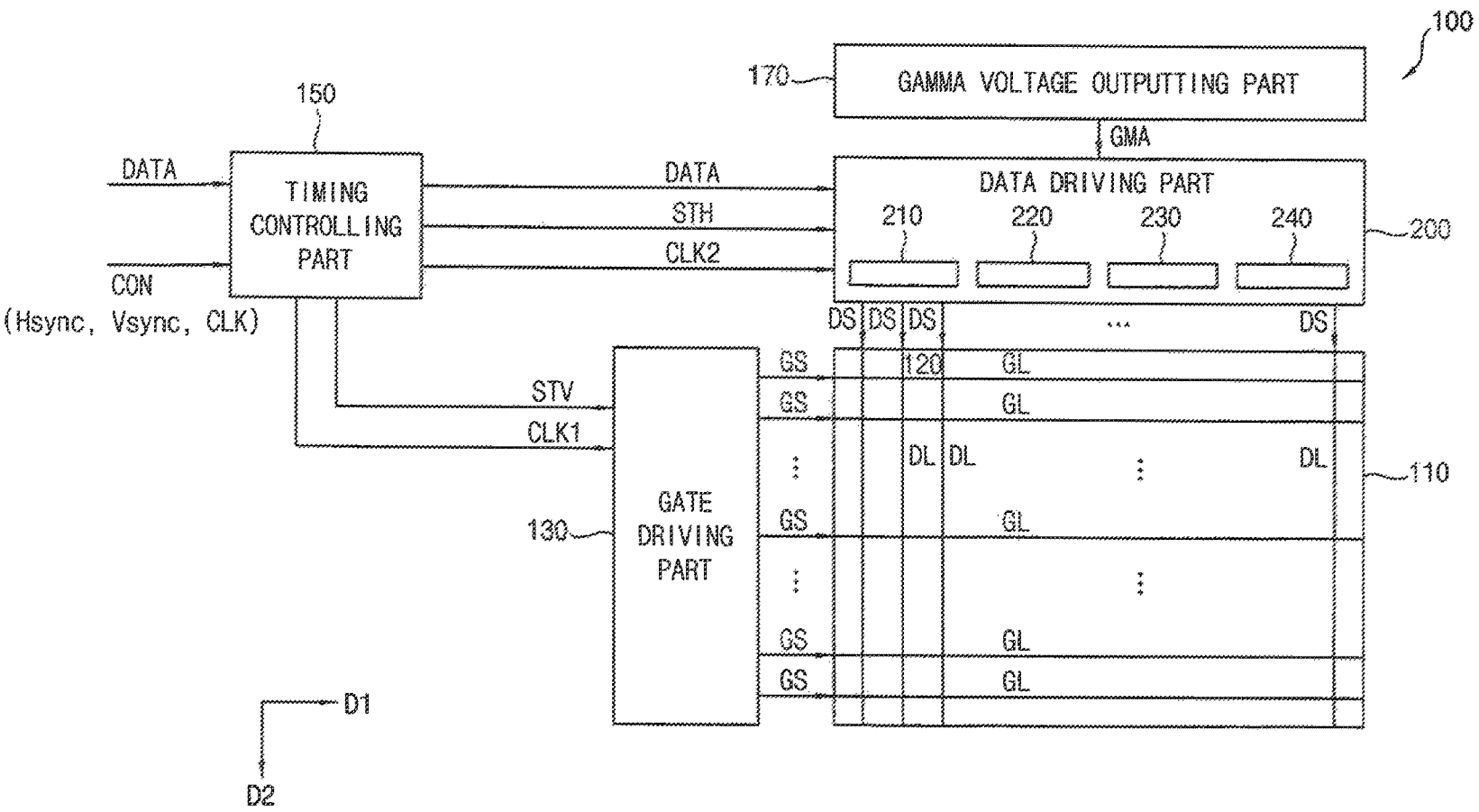
FIG. 1 is a block diagram illustrating a display apparatus according to an exemplary embodiment of the present inventive concept.

Hereinafter, the present inventive concept will be explained in detail with reference to the accompanying drawings. This inventive concept may, however, be embodied in many different forms and should not be construed as limited to the embodiments set forth herein. Like reference numerals refer to like elements throughout this application. As used herein, the singular forms, "a," "an" and "the" are intended to include the plural forms as well, unless the context clearly indicates otherwise.

FIG. 1 is a block diagram illustrating a display apparatus according to an exemplary embodiment of the present inventive concept.

Referring to FIG. 1, the display apparatus 100 according to the present exemplary embodiment includes a display panel 110, a gate driving part 130 (e.g., a gate driver or gate driving circuit), a data driving part 200 (e.g., a data driver or a data driving circuit), a timing controlling part 150 (e.g., a controller or controller circuit) and a gamma voltage outputting part 170 (e.g., a gamma voltage generator).

The display panel 110 receives a data signal DS based on image data DATA provided from the timing controlling part 150 to display an image. The display panel 110 includes gate lines GL, data lines DL and pixels 120. The gate lines GL extend in a first direction D1 and are arranged in a second direction D2 substantially perpendicular to the first direction D1. The data lines DL extend in the second direction D2 and are arranged in the first direction D1. Here, the first direction D1 may be parallel to a long side of the display panel 110, and the second direction D2 may be parallel to a short side of the display panel 110.

Figure 2:
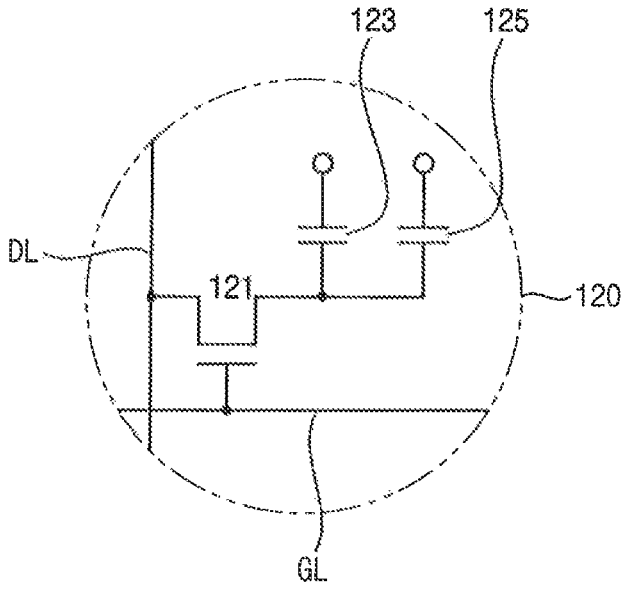
FIG. 2 is a circuit diagram illustrating a pixel of FIG. 1.

FIG. 2 is a circuit diagram illustrating the pixel 120 of FIG. 1.

Referring to FIGS. 1 and 2, the pixels 120 are defined each of the gate lines GL and each of the data lines DL. For example, the pixel 120 may include a thin film transistor 121 electrically connected to the gate line GL and the data line DL, a liquid crystal capacitor 123 and a storage capacitor 125 connected to the thin film transistor 121. Thus, the display panel 110 may be a liquid crystal display panel.

The gate driving part 130, the data driving part 200, the timing controlling part 150 and the gamma voltage outputting part 170 may be defined as a display panel driving apparatus for driving the display panel 110.

The gate driving part 130 generates a gate signal GS in response to a vertical start signal STV and a first clock signal CLK1 provided from the timing controlling part 150, and outputs the gate signal GS to the gate line GL.

The data driving part 200 receives the image data DATA from the timing controlling part 150, generates the data signal DS based on the image data DATA, and outputs the data signal DS to the data line DL in response to a horizontal start signal STH and a second clock signal CLK2 provided from the timing controlling part 150. The data driving part 200 generates the data signal DS using a gamma voltage GMA provided from the gamma voltage outputting part 170. The data driving part 200 may include a plurality of data driving integrated circuits 210, 220, 230 and 240 generating and outputting the data signal DS. For example, the data driving integrated circuits 210, 220, 230 and 240 may include a first data driving integrated circuit 210, a second data driving integrated circuit 220, a third data driving integrated circuit 230 and a fourth data driving integrated circuit 240. For example, one of the data driving integrated circuits may be used to apply a data signal to a first group of the data lines and another one of the data driving integrated circuits may be used to apply a data signal to a second other group of the data lines.

The timing controlling part 150 receives the image data DATA, and a control signal CON from an outside source. The control signal CON may include a horizontal synchronous signal Hsync, a vertical synchronous signal Vsync and a clock signal CLK. The timing controlling part 150 generates the horizontal start signal STH using the horizontal synchronous signal Hsync and outputs the horizontal start signal STH to the data driving part 200. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 200.

The gamma voltage outputting part 170 generates the gamma voltage GMA and outputs the gamma voltage GMA to the data driving part 200. The gamma voltage GMA may be used to perform gamma correction on the image data DATA.

Figure 3:
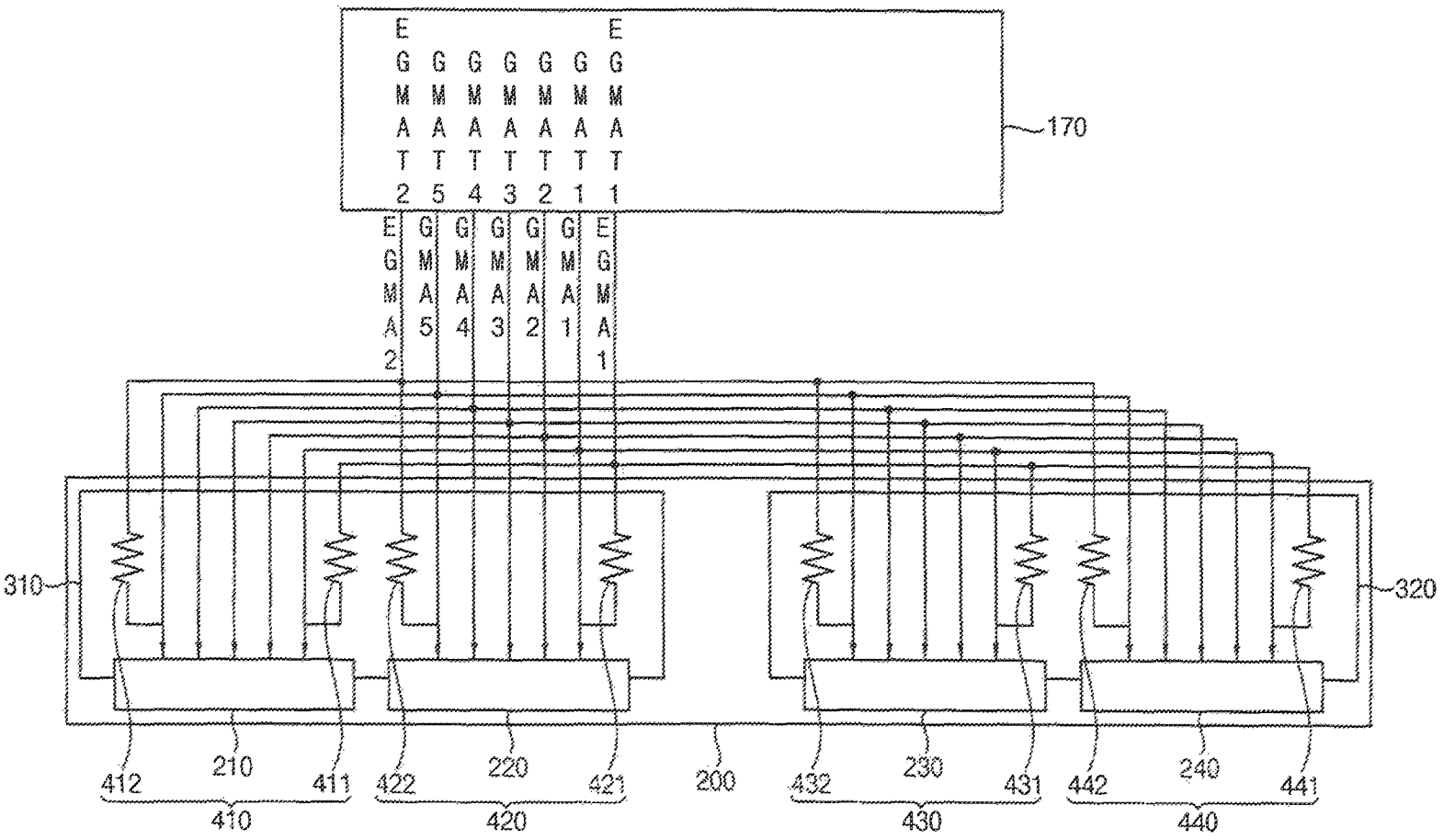
FIG. 3 is a block diagram illustrating a gamma voltage outputting part and a data driving part in the display apparatus of FIG. 1.

FIG. 3 is a block diagram illustrating the gamma voltage outputting part 170 and the data driving part 200 in the display apparatus 100 of FIG. 1.

Referring to FIGS. 1 and 3, the gamma voltage outputting part 170 outputs the gamma voltage GMA to the data driving part 200. The gamma voltage GMA may include N (N is a natural number greater than two) gamma voltages. For example, the gamma voltage GMA may include a first gamma voltage GMA1, a second gamma voltage GMA2, a third gamma voltage GMA3, a fourth gamma voltage GMA4 and a fifth gamma voltage GMA5. Thus, the gamma voltage outputting part 170 may output the first gamma voltage GMA1, the second gamma voltage GMA2, the third gamma voltage GMA3, the fourth gamma voltage GMA4 and the fifth gamma voltage GMA5. Here, the fifth gamma voltage GMA5 may correspond to an N-th gamma voltage. The gamma voltage outputting part 170 may output the first gamma voltage GMA1, the second gamma voltage GMA2, the third gamma voltage GMA3, the fourth gamma voltage GMA4 and the fifth gamma voltage GMA5 to each of the first data driving integrated circuit 210, the second data driving integrated circuit 220, the third data driving integrated circuit 230 and the fourth data driving integrated circuit 240. In an embodiment, the gamma voltage outputting part 170 includes a first gamma voltage output terminal GMAT1 outputting the first gamma voltage GMA1, a second gamma voltage output terminal GMAT2 outputting the second gamma voltage GMA2, a third gamma voltage output terminal GMAT3 outputting the third gamma voltage GMA3, a fourth gamma voltage output terminal GMAT4 outputting the fourth gamma voltage GMA4 and a fifth gamma voltage output terminal GMAT5 outputting the fifth gamma voltage GMA5.

In an embodiment, the first gamma voltage GMA1, the second gamma voltage GMA2, the third gamma voltage GMA3, the fourth gamma voltage GMA4 and the fifth gamma voltage GMA5 sequentially decrease. In an embodiment, the first gamma voltage GMA1, the second gamma voltage GMA2, the third gamma voltage GMA3, the fourth gamma voltage GMA4 and the fifth gamma voltage GMA5 linearly decrease.

In an embodiment, the gamma voltage outputting part 170 further outputs a first extra gamma voltage EGMA1 and a second extra gamma voltage EGMA2. The first extra gamma voltage EGMA1 and the second extra gamma voltage EGMA2 are not directly applied to the first data driving integrated circuit 210, the second data driving integrated circuit 220, the third data driving integrated circuit 230 and the fourth data driving integrated circuit 240. The first extra gamma voltage EGMA1 is greater than the first gamma voltage GMA1, and the second extra gamma voltage EGMA2 is less than the fifth gamma voltage GMA5.

In an embodiment, the data driving part 200 includes a first data printed circuit board 310 and a second data printed circuit board 320. In an embodiment, the first data driving integrated circuit 210 and the second data driving integrated circuit 220 are disposed on the first data printed circuit board 310. In this embodiment, the third data driving integrated circuit 230 and the fourth data driving integrated circuit 240 are disposed on the second data printed circuit board 320.

The first data driving integrated circuit 210 receives the first gamma voltage GMA1, the second gamma voltage GMA2, the third gamma voltage GMA3, the fourth gamma voltage GMA4 and the fifth gamma voltage GMA5 from the gamma voltage outputting part 170. The first data driving integrated circuit 210 generates and outputs the data signal DS using the first gamma voltage GMA1, the second gamma voltage GMA2, the third gamma voltage GMA3, the fourth gamma voltage GMA4 and the fifth gamma voltage GMA5.

The second data driving integrated circuit 220 receives the first gamma voltage GMA1, the second gamma voltage GMA2, the third gamma voltage GMA3, the fourth gamma voltage GMA4 and the fifth gamma voltage GMA5 from the gamma voltage outputting part 170. The second data driving integrated circuit 220 generates and outputs the data signal DS using the first gamma voltage GMA1, the second gamma voltage GMA2, the third gamma voltage GMA3, the fourth gamma voltage GMA4 and the fifth gamma voltage GMA5.

The third data driving integrated circuit 230 receives the first gamma voltage GMA1, the second gamma voltage GMA2, the third gamma voltage GMA3, the fourth gamma voltage GMA4 and the fifth gamma voltage GMA5 from the gamma voltage outputting part 170. The third data driving integrated circuit 230 generates and outputs the data signal DS using the first gamma voltage GMA1, the second gamma voltage GMA2, the third gamma voltage GMA3, the fourth gamma voltage GMA4 and the fifth gamma voltage GMA5.

The fourth data driving integrated circuit 240 receives the first gamma voltage GMA1, the second gamma voltage GMA2, the third gamma voltage GMA3, the fourth gamma voltage GMA4 and the fifth gamma voltage GMA5 from the gamma voltage outputting part 170. The fourth data driving integrated circuit 240 generates and outputs the data signal DS using the first gamma voltage GMA1, the second gamma voltage GMA2, the third gamma voltage GMA3, the fourth gamma voltage GMA4 and the fifth gamma voltage GMA5.

In an exemplary embodiment of the inventive concept, the display apparatus 100 includes a first extra resistance part 410, a second extra resistance part 420, a third extra resistance part 430 and a fourth extra resistance part 440. The first extra resistance part 410, the second extra resistance part 420, the third extra resistance part 430 and the fourth extra resistance part 440 may be included in the display panel driving apparatus which drives the display panel 110.

The first extra resistance part 410 is electrically connected between the gamma voltage outputting part 170 and the first data driving integrated circuit 210. Specifically, the first extra resistance part 410 is electrically connected between the first and second extra gamma voltage output terminals EGMAT1 and EGMAT2 and the first data driving integrated circuit 210. The first extra resistance part 410 includes a first extra resistor 411 and a second extra resistor 412. The first extra resistor 411 is electrically connected between the first extra gamma voltage output terminal EGMAT1 and the first data driving integrated circuit 210. The second extra resistor 412 is electrically connected between the second extra gamma voltage output terminal EGMAT2 and the first data driving integrated circuit 210.

The second extra resistance part 420 is electrically connected between the gamma voltage outputting part 170 and the second data driving integrated circuit 220. Specifically, the second extra resistance part 420 is electrically connected between the first and second extra gamma voltage output terminals EGMAT1 and EGMAT2 and the second data driving integrated circuit 220. The second extra resistance part 420 includes a third extra resistor 421 and a fourth extra resistor 422. The third extra resistor 421 is electrically connected between the first extra gamma voltage output terminal EGMAT1 and the second data driving integrated circuit 220. The fourth extra resistor 422 is electrically connected between the second extra gamma voltage output terminal EGMAT2 and the second data driving integrated circuit 220.

The third extra resistance part 430 is electrically connected between the gamma voltage outputting part 170 and the third data driving integrated circuit 230. Specifically, the third extra resistance part 430 is electrically connected between the first and second extra gamma voltage output terminals EGMAT1 and EGMAT2 and the third data driving integrated circuit 230. The third extra resistance part 430 includes a fifth extra resistor 431 and a sixth extra resistor 432. The fifth extra resistor 431 is electrically connected between the first extra gamma voltage output terminal EGMAT1 and the third data driving integrated circuit 230. The sixth extra resistor 432 is electrically connected between the second extra gamma voltage output terminal EGMAT2 and the third data driving integrated circuit 230.

The fourth extra resistance part 440 is electrically connected between the gamma voltage outputting part 170 and the fourth data driving integrated circuit 240. Specifically, the fourth extra resistance part 440 is electrically connected between the first and second extra gamma voltage output terminals EGMAT1 and EGMAT2 and the fourth data driving integrated circuit 240. The fourth extra resistance part 440 includes a seventh extra resistor 441 and an eighth extra resistor 442. The seventh extra resistor 441 is electrically connected between the first extra gamma voltage output terminal EGMAT1 and the fourth data driving integrated circuit 240. The eighth extra resistor 442 is electrically connected between the second extra gamma voltage output terminal EGMAT2 and the fourth data driving integrated circuit 240.

Figure 4:
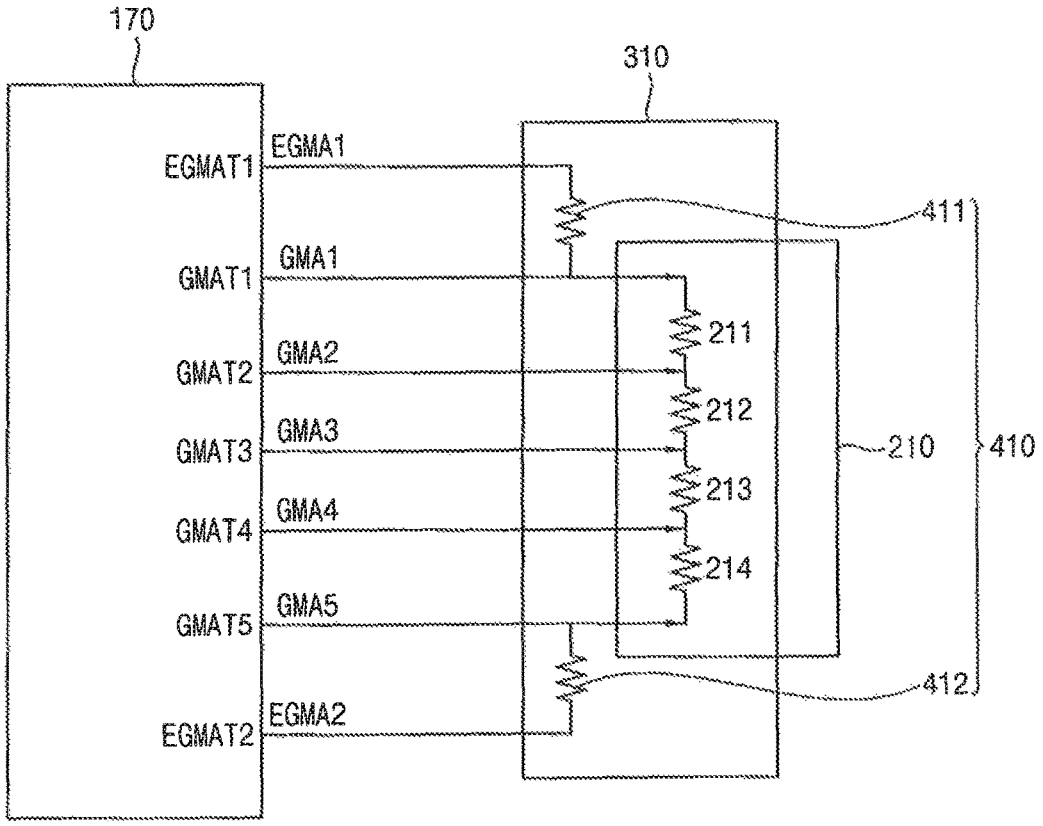
FIG. 4 is a circuit diagram illustrating the gamma voltage outputting part, a first data driving integrated circuit and a first extra resistance part of FIG. 3.

FIG. 4 is a circuit diagram illustrating the gamma voltage outputting part 170, the first data driving integrated circuit 210 and the first extra resistance part 410 of FIG. 3.

Referring to FIGS. 1, 3 and 4, the first data driving integrated circuit 210 includes a resistor string to which the first gamma voltage GMA1, the second gamma voltage GMA2, the third gamma voltage GMA3, the fourth gamma voltage GMA4 and the fifth gamma voltage GMA5 are applied. For example, the resistor string includes a first resistor 211, a second resistor 212, a third resistor 213 and a fourth resistor 214. The first resistor 211 is connected between the first gamma voltage output terminal GMAT1 outputting the first gamma voltage GMA1 and the second gamma voltage output terminal GMAT2 outputting the second gamma voltage GMA2. The second resistor 212 is connected between the second gamma voltage output terminal GMAT2 outputting the second gamma voltage GMA2 and the third gamma voltage output terminal GMAT3 outputting the third gamma voltage GMA3. The third resistor 213 is connected between the third gamma voltage output terminal GMAT3 outputting the third gamma voltage GMA3 and the fourth gamma voltage output terminal GMAT4 outputting the fourth gamma voltage GMA4. The fourth resistor 214 is connected between the fourth gamma voltage output terminal GMAT4 outputting the fourth gamma voltage GMA4 and the fifth gamma voltage output terminal GMAT5 outputting the fifth gamma voltage GMA5. In an embodiment, a resistance of the first resistor 211, a resistance of the second resistor 212, a resistance of the third resistor 213, and a resistance of the fourth resistor 214 are the same.

The first extra resistance part 410 includes the first extra resistor 411 and the second extra resistor 412. The first extra resistor 411 is electrically connected between the first extra gamma voltage output terminal EGMAT1 outputting the first extra gamma voltage EGMA1 and the first gamma voltage output terminal GMAT1 outputting the first gamma voltage GMA1. The second extra resistor 412 is electrically connected between the second extra gamma voltage output terminal EGMAT2 outputting the second extra gamma voltage EGMA2 and the fifth gamma voltage output terminal GMAT5 outputting the fifth gamma voltage GMA5. In an embodiment, each of resistances of the first extra resistor 411 and the second extra resistor 412 is the same as each of the resistances of the first resistor 211, the second resistor 212, the third resistor 213 and the fourth resistor 214.

When a difference between the first gamma voltage GMA1 and the fifth gamma voltage GMA5 is determined, the first gamma voltage GMA1, the second gamma voltage GMA2, the third gamma voltage GMA3 and the fourth gamma voltage GMA4 may be calculated by the following equations 1 to 4.

$$GMA1=GMA2+(GMA1-GMA5)/(N-1) \quad \text{[Equation 1]}$$

$$GMA2=GMA1+(GMA1-GMA5)/(N-1) \quad \text{[Equation 2]}$$

$$GMA3=GMA2+(GMA1-GMA5)/(N-1) \quad \text{[Equation 3]}$$

$$GMA4=GMA3+(GMA1-GMA5)/(N-1) \quad \text{[Equation 4]}$$

Here, 'GMA1' denotes the first gamma voltage GMA1, 'GMA2' denotes the second gamma voltage GMA2, 'GMA3' denotes the third gamma voltage GMA3, 'GMA4' denotes the fourth gamma voltage, 'GMA5' denotes the fifth gamma voltage GMA5, and 'N' denotes the number of the gamma voltages GMA. For example, here 'N' would be 5 since there are 5 gamma voltages.

In an exemplary embodiment, the first extra gamma voltage EGMA1 is calculated by the following equation 5.

$$EGMA1=GMA1+(GMA1-GMAN)/(N-1)*(PR1+ER1)/R \quad \text{[Equation 5]}$$

Here, 'EGMA1' denotes the first extra gamma voltage EGMA1, 'GMA1' denotes the first gamma voltage GMA1, 'GMAN' denotes the N-th gamma voltage, 'N' denotes the number of the gamma voltages GMA, 'PR1' denotes a resistance of a first path resistor between the first extra gamma voltage output terminal EGMAT1 and the first extra resistor 411, 'ER1' denotes the resistance of the first extra resistor 411, 'R' denotes one of the resistances of the first resistor 211, the second resistor 212, the third resistor 213, the fourth resistor 214 and the fifth resistor 215. For example, here 'GMAN' is the voltage of the fifth gamma voltage GMA5. In an embodiment, 'PR1' is the resistance of the signal line connecting the first extra gamma voltage output terminal EGMAT1 and the first extra resistor 411.

In an exemplary embodiment of the inventive concept, the second extra gamma voltage EGMA2 is calculated by the following equation 6.

$$EGMA2=GMAN-(GMA1-GMAN)/(N-1)*(PR2+ER2)/R \quad \text{[Equation 6]}$$

Here, 'EGMA2' denotes the second extra gamma voltage EGMA2, 'GMA1' denotes the first gamma voltage GMA1, 'GMAN' denotes the N-th gamma voltage, 'N' denotes the number of the gamma voltages GMA, 'PR2' denotes a resistance of a second path resistor between the second extra gamma voltage output terminal EGAMT2 and the second extra resistor 412, 'ER2' denotes the resistance of the second extra resistor 412, 'R' denotes one of the resistances of the first resistor 211, the second resistor 212, the third resistor 213, the fourth resistor 214 and the fifth resistor 215. In an embodiment, 'PR2' is the resistance of the signal line connecting the second extra gamma voltage output terminal EGMAT2 and the second extra resistor 412.

A constant current (or a static current) sequentially passes through the first extra gamma voltage output terminal EGMAT1, the first extra resistor 411, the first resistor 211, the second resistor 212, the third resistor 213, the fourth resistor 214, the second extra resistor 412 and the second extra gamma voltage output terminal EGMAT2. Thus, a constant current between the first gamma voltage output terminal GMAT1 and the first data driving integrated circuit 210 may decrease. In addition, a constant current between the second gamma voltage output terminal GMAT2 and the first data driving integrated circuit 210 may decrease. In addition, a constant current between the third gamma voltage output terminal GMAT3 and the first data driving integrated circuit 210 may decrease. In addition, a constant current between the fourth gamma voltage output terminal GMAT4 and the first data driving integrated circuit 210 may decrease. In addition, a constant current between the fifth gamma voltage output terminal GMAT5 and the first data driving integrated circuit 210 may decrease.

Figure 5:
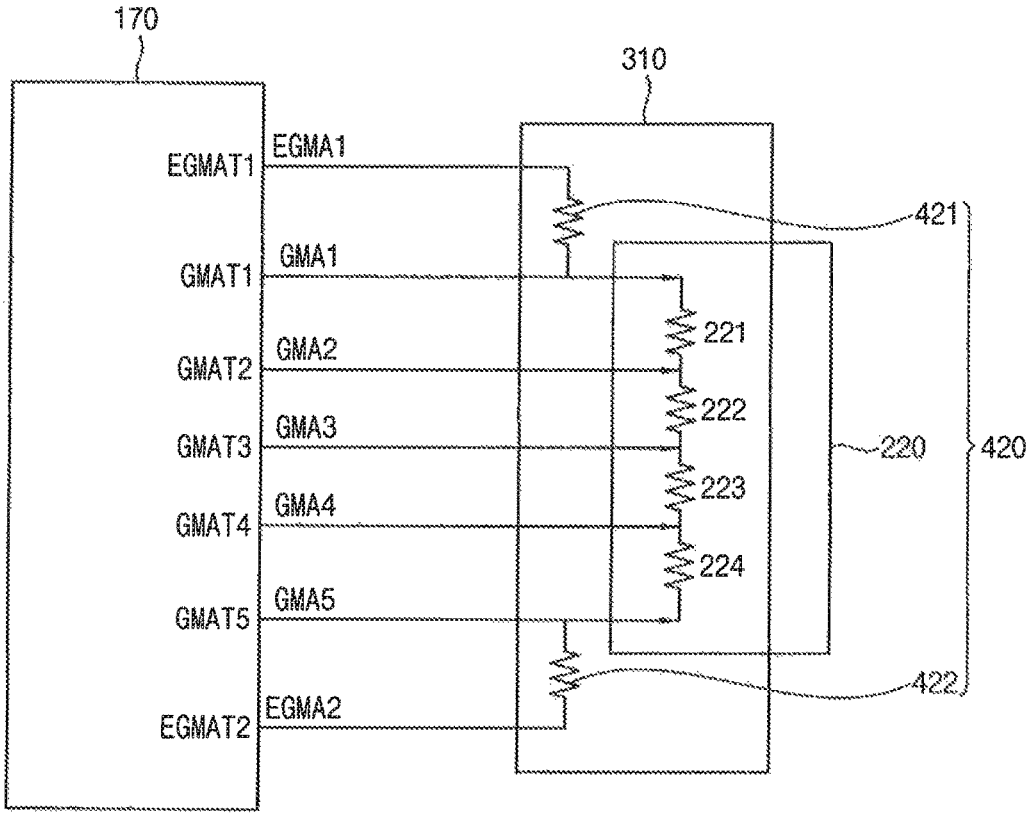
FIG. 5 is a circuit diagram illustrating the gamma voltage outputting part, a second data driving integrated circuit and a second extra resistance part of FIG. 3.

FIG. 5 is a circuit diagram illustrating the gamma voltage outputting part 170, the second data driving integrated circuit 220 and the second extra resistance part 420 of FIG. 3.

Referring to FIGS. 1, 3 and 5, the second data driving integrated circuit 220 includes a resistor string to which the first gamma voltage GMA1, the second gamma voltage GMA2, the third gamma voltage GMA3, the fourth gamma voltage GMA4 and the fifth gamma voltage GMA5 are applied. For example, the resistor string includes a fifth resistor 221, a sixth resistor 222, a seventh resistor 223 and an eighth resistor 224. The fifth resistor 221 is connected between the first gamma voltage output terminal GMAT1 outputting the first gamma voltage GMA1 and the second gamma voltage output terminal GMAT2 outputting the second gamma voltage GMA2. The sixth resistor 222 is connected between the second gamma voltage output terminal GMAT2 outputting the second gamma voltage GMA2 and the third gamma voltage output terminal GMAT3 outputting the third gamma voltage GMA3. The seventh resistor 223 is connected between the third gamma voltage output terminal GMAT3 outputting the third gamma voltage GMA3 and the fourth gamma voltage output terminal GMAT4 outputting the fourth gamma voltage GMA4. The eighth resistor 224 is connected between the fourth gamma voltage output terminal GMAT4 outputting the fourth gamma voltage GMA4 and the fifth gamma voltage output terminal GMAT5 outputting the fifth gamma voltage GMA5. In an embodiment, a resistance of the fifth resistor 221, a resistance of the sixth resistor 222, a resistance of the seventh resistor 223, and a resistance of the eighth resistor 224 are the same.

The second extra resistance part 420 includes the third extra resistor 421 and the fourth extra resistor 422. The third extra resistor 421 is electrically connected between the first extra gamma voltage output terminal EGMAT1 outputting the first extra gamma voltage EGMA1 and the first gamma voltage output terminal GMAT1 outputting the first gamma voltage GMA1. The fourth extra resistor 422 is electrically connected between the second extra gamma voltage output terminal EGMAT2 outputting the second extra gamma voltage EGMA2 and the fifth gamma voltage output terminal GMAT5 outputting the fifth gamma voltage GMA5. In an embodiment, each of resistances of the third extra resistor 421 and the fourth extra resistor 422 is the same as each of the resistances of the fifth resistor 221, the sixth resistor 222, the seventh resistor 223 and the eighth resistor 224.

A constant current sequentially passes through the first extra gamma voltage output terminal EGMAT1, the third extra resistor 421, the fifth resistor 221, the sixth resistor 222, the seventh resistor 223, the eighth resistor 224, the fourth extra resistor 422 and the second extra gamma voltage output terminal EGMAT2. Thus, a constant current between the first gamma voltage output terminal GMAT1 and the second data driving integrated circuit 220 may decrease. In addition, a constant current between the second gamma voltage output terminal GMAT2 and the second data driving integrated circuit 220 may decrease. In addition, a constant current between the third gamma voltage output terminal GMAT3 and the second data driving integrated circuit 220 may decrease. In addition, a constant current between the fourth gamma voltage output terminal GMAT4 and the second data driving integrated circuit 220 may decrease. In addition, a constant current between the fifth gamma voltage output terminal GMAT5 and the second data driving integrated circuit 220 may decrease.

Figure 6:
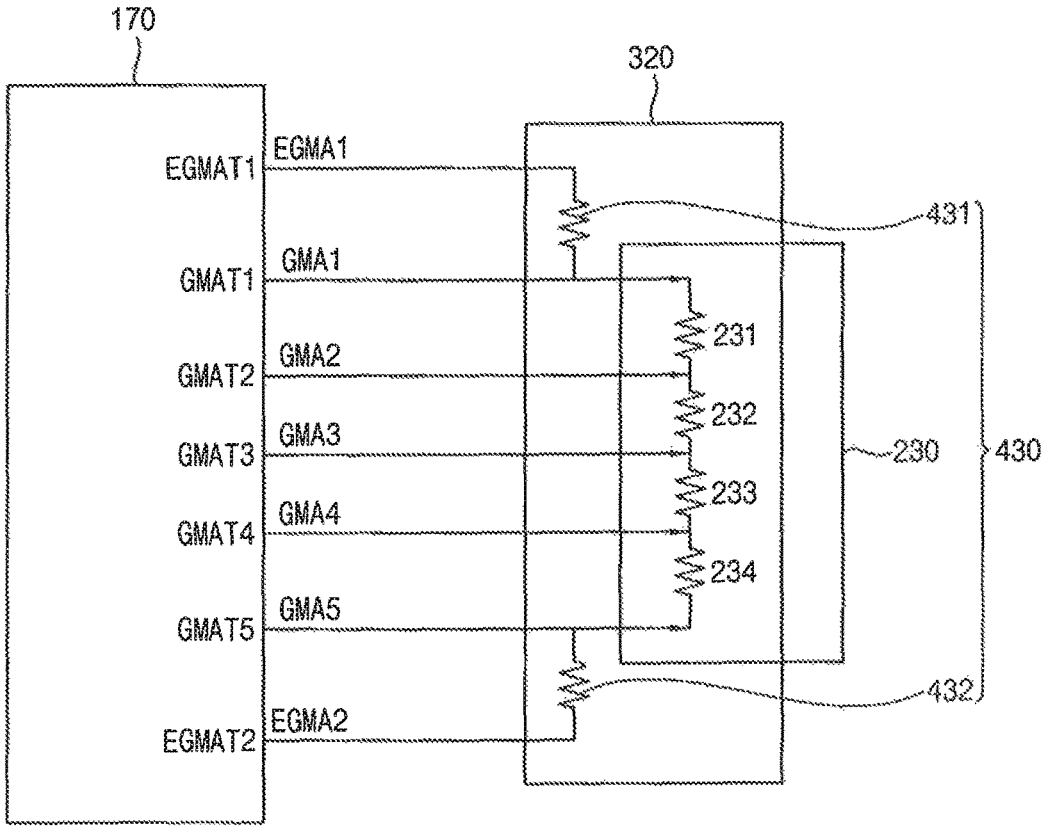
FIG. 6 is a circuit diagram illustrating the gamma voltage outputting part, a third data driving integrated circuit and a third extra resistance part of FIG. 3.

FIG. 6 is a circuit diagram illustrating the gamma voltage outputting part 170, the third data driving integrated circuit 230 and the third extra resistance part 430 of FIG. 3.

Referring to FIGS. 1, 3 and 6, the third data driving integrated circuit 230 includes a resistor string to which the first gamma voltage GMA1, the second gamma voltage GMA2, the third gamma voltage GMA3, the fourth gamma voltage GMA4 and the fifth gamma voltage GMA5 are applied. For example, the resistor string includes a ninth resistor 231, a tenth resistor 232, an eleventh resistor 233 and a twelfth resistor 234. The ninth resistor 231 is connected between the first gamma voltage output terminal GMAT1 outputting the first gamma voltage GMA1 and the second gamma voltage output terminal GMAT2 outputting the second gamma voltage GMA2. The tenth resistor 232 is connected between the second gamma voltage output terminal GMAT2 outputting the second gamma voltage GMA2 and the third gamma voltage output terminal GMAT3 outputting the third gamma voltage GMA3. The eleventh resistor 233 is connected between the third gamma voltage output terminal GMAT3 outputting the third gamma voltage GMA3 and the fourth gamma voltage output terminal GMAT4 outputting the fourth gamma voltage GMA4. The twelfth resistor 234 is connected between the fourth gamma voltage output terminal GMAT4 outputting the fourth gamma voltage GMA4 and the fifth gamma voltage output terminal GMAT5 outputting the fifth gamma voltage GMA5. In an embodiment, a resistance of the ninth resistor 231, a resistance of the tenth resistor 232, a resistance of the eleventh resistor 233, and a resistance of the twelfth resistor 234 are the same.

The third extra resistance part 430 includes the fifth extra resistor 431 and the sixth extra resistor 432. The fifth extra resistor 431 is electrically connected between the first extra gamma voltage output terminal EGMAT1 outputting the first extra gamma voltage EGMA1 and the first gamma voltage output terminal GMAT1 outputting the first gamma voltage GMA1 The sixth extra resistor 432 is electrically connected between the second extra gamma voltage output terminal EGMAT2 outputting the second extra gamma voltage EGMA2 and the fifth gamma voltage output terminal GMAT5 outputting the fifth gamma voltage GMA5. In an embodiment, each of resistances of the fifth extra resistor 431 and the sixth extra resistor 432 are the same as each of the resistances of the ninth resistor 231, the tenth resistor 232, the eleventh resistor 233 and the twelfth resistor 234.

A constant current sequentially passes through the first extra gamma voltage output terminal EGMAT1, the fifth extra resistor 431, the ninth resistor 231, the tenth resistor 232, the eleventh resistor 233, the twelfth resistor 234, the sixth extra resistor 432 and the second extra gamma voltage output terminal EGMAT2. Thus, a constant current between the first gamma voltage output terminal GMAT1 and the third data driving integrated circuit 230 may decrease. In addition, a constant current between the second gamma voltage output terminal GMAT2 and the third data driving integrated circuit 230 may decrease. In addition, a constant current between the third gamma voltage output terminal GMAT3 and the third data driving integrated circuit 230 may decrease. In addition, a constant current between the fourth gamma voltage output terminal GMAT4 and the third data driving integrated circuit 230 may decrease. In addition, a constant current between the fifth gamma voltage output terminal GMAT5 and the third data driving integrated circuit 230 may decrease.

Figure 7:
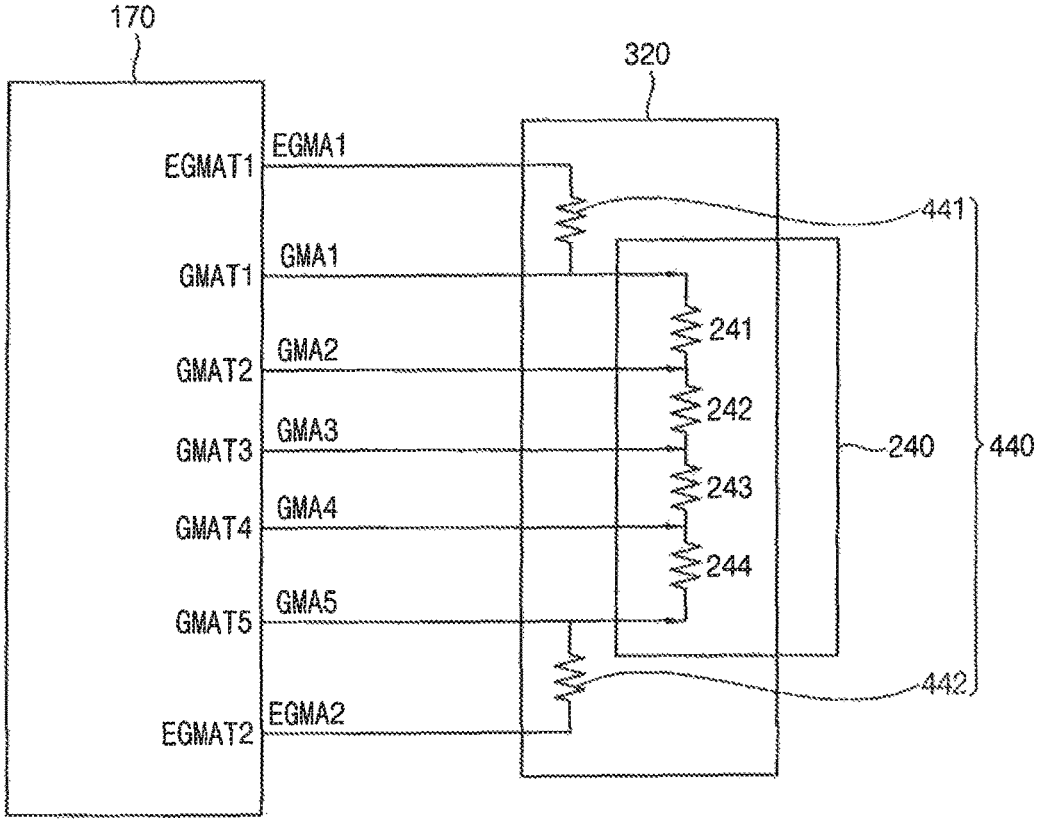
FIG. 7 is a circuit diagram illustrating the gamma voltage outputting part, a fourth data driving integrated circuit and a fourth extra resistance part of FIG. 3.

FIG. 7 is a circuit diagram illustrating the gamma voltage outputting part 170, the fourth data driving integrated circuit 240 and the fourth extra resistance part 440 of FIG. 3.

Referring to FIGS. 1, 3 and 7, the fourth data driving integrated circuit 240 includes a resistor string to which the first gamma voltage GMA1, the second gamma voltage GMA2, the third gamma voltage GMA3, the fourth gamma voltage GMA4 and the fifth gamma voltage GMA5 are applied. For example, the resistor string includes a thirteenth resistor 241, a fourteenth resistor 242, a fifteenth resistor 243 and a sixteenth resistor 244. The thirteenth resistor 241 is connected between the first gamma voltage output terminal GMAT1 outputting the first gamma voltage GMA1 and the second gamma voltage output terminal GMAT2 outputting the second gamma voltage GMA2. The fourteenth resistor 242 is connected between the second gamma voltage output terminal GMAT2 outputting the second gamma voltage GMA2 and the third gamma voltage output terminal GMAT3 outputting the third gamma voltage GMA3. The fifteenth resistor 243 is connected between the third gamma voltage output terminal GMAT3 outputting the third gamma voltage GMA3 and the fourth gamma voltage output terminal GMAT4 outputting the fourth gamma voltage GMA4. The sixteenth resistor 244 is connected between the fourth gamma voltage output terminal GMAT4 outputting the fourth gamma voltage GMA4 and the fifth gamma voltage output terminal GMAT5 outputting the fifth gamma voltage GMA5. In an embodiment, a resistance of the thirteenth resistor 241, a resistance of the fourteenth 242, a resistance of the fifteenth resistor 243, and a resistance of the sixteenth resistor 244 are the same.

The fourth extra resistance part 440 includes the seventh extra resistor 441 and the eighth extra resistor 442. The seventh extra resistor 441 is electrically connected between the first extra gamma voltage output terminal EGMAT1 outputting the first extra gamma voltage EGMA1 and the first gamma voltage output terminal GMAT1 outputting the first gamma voltage GMA1. The eighth extra resistor 442 is electrically connected between the second extra gamma voltage output terminal EGMAT2 outputting the second extra gamma voltage EGMA2 and the fifth gamma voltage output terminal GMAT5 outputting the fifth gamma voltage GMA5. In an embodiment, each of the resistances of the seventh extra resistor 441 and the eighth extra resistor 442 are the same as each of the resistances of the thirteenth resistor 241, the fourteenth resistor 242, the fifteenth resistor 243 and the sixteenth resistor 244.

A constant current sequentially passes through the first extra gamma voltage output terminal EGMAT1, the seventh extra resistor 441, the thirteenth resistor 241, the fourteenth resistor 242, the fifteenth resistor 243, the sixteenth resistor 244, the eighth extra resistor 442 and the second extra gamma voltage output terminal EGMAT2. Thus, a constant current between the first gamma voltage output terminal GMAT1 and the fourth data driving integrated circuit 240 may decrease. In addition, a constant current between the second gamma voltage output terminal GMAT2 and the fourth data driving integrated circuit 240 may decrease. In addition, a constant current between the third gamma voltage output terminal GMAT3 and the fourth data driving integrated circuit 240 may decrease. In addition, a constant current between the fourth gamma voltage output terminal GMAT4 and the fourth data driving integrated circuit 240 may decrease. In addition, a constant current between the fifth gamma voltage output terminal GMAT5 and the fourth data driving integrated circuit 240 may decrease.

According to the present exemplary embodiment, the constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the first data driving integrated circuit 210 may decrease. In addition, the constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the second data driving integrated circuit 220 may decrease. In addition, the constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the third data driving integrated circuit 230 may decrease. In addition, the constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the fourth data driving integrated circuit 240 may decrease.

Therefore, a current-resistance drop and rise (i.e., IR drop and rise) between the gamma voltage outputting part 170 and the first data printed circuit board 310 may be removed. In addition, a current-resistance drop and rise (i.e., IR drop and rise) between the gamma voltage outputting part 170 and the second data printed circuit board 320 may be removed.

Thus, a color difference between an area of the display panel 110 receiving the data signal DS output from the first data driving integrated circuit 210 and the second data driving integrated circuit 220 which are disposed on the first data printed circuit board 310, and an area of the display panel 110 receiving the data signal DS output from the third data driving integrated circuit 230 and the fourth data driving integrated circuit 240 which are disposed on the second data printed circuit board 320 may be decreased. Accordingly, display quality of the display apparatus 100 may be improved.

Figure 8:
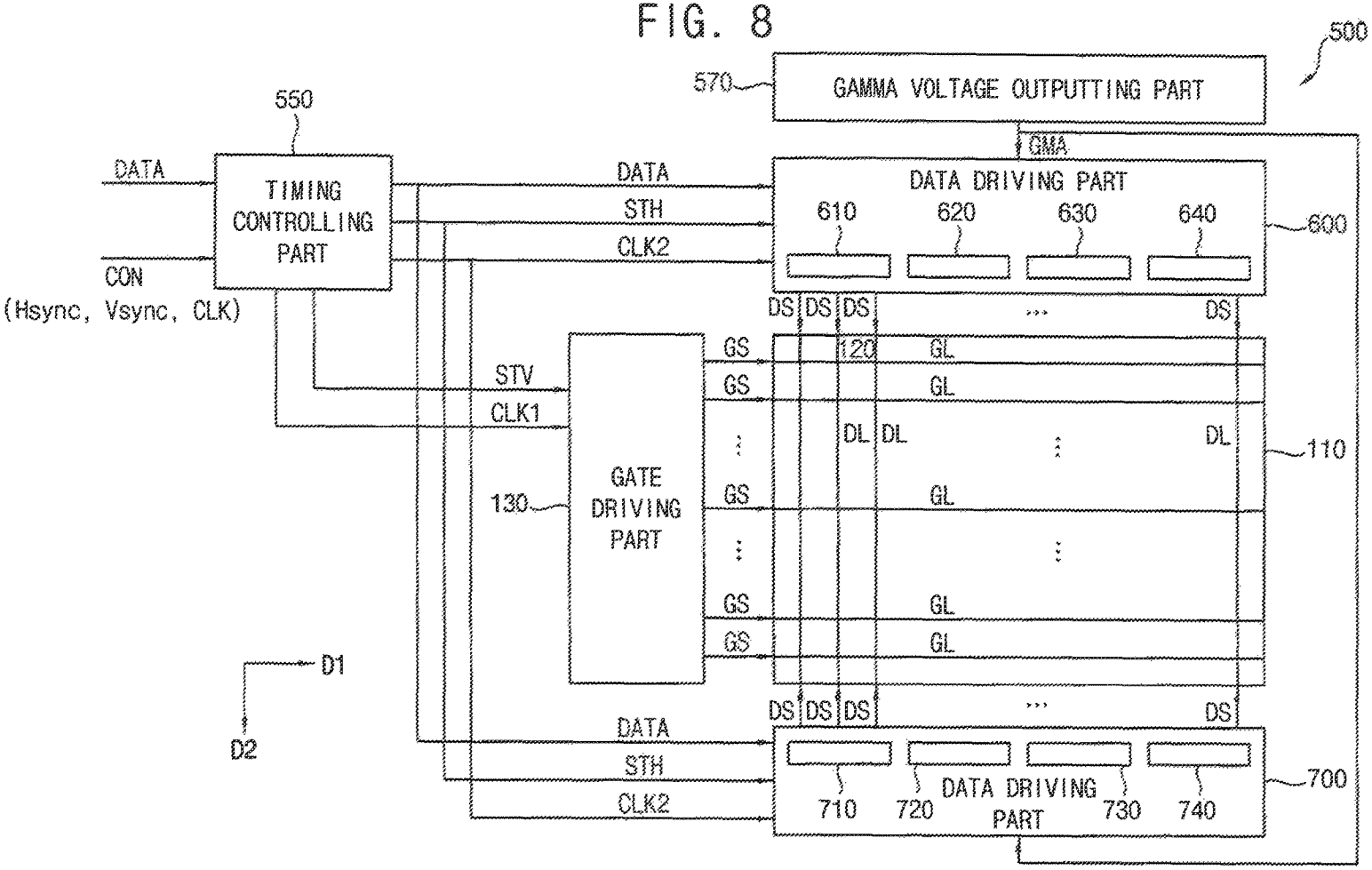
FIG. 8 is a block diagram illustrating a display apparatus according to an exemplary embodiment of the present inventive concept.

FIG. 8 is a block diagram illustrating a display apparatus according to an exemplary embodiment of the present inventive concept.

The display apparatus 500 according to the present exemplary embodiment illustrated in FIG. 8 is substantially the same as the display apparatus 100 according to the previously exemplary embodiment illustrated in FIG. 1 except for a first data driving part 600, a second data driving part 700, a timing controlling part 550 and a gamma voltage outputting part 570. Thus, the same reference numerals will be used to refer to same or like parts as those described in the previous exemplary embodiment and any further repetitive explanation concerning the above elements will be omitted.

Referring to FIG. 8, the display apparatus 500 according to the present exemplary embodiment includes the display panel 110, the gate driving part 130, the first data driving part 600, the second data driving part 700, the timing controlling part 550 and the gamma voltage outputting part 570.

The display panel 110 receives the data signal DS based on the image data DATA provided from the timing controlling part 550 to display an image.

The gate driving part 130, the first data driving part 600, the second data driving part 700, the timing controlling part 550 and the gamma voltage outputting part 570 may be defined as a display panel driving apparatus for driving the display panel 110.

The gate driving part 130 generates the gate signal GS in response to the vertical start signal STV and the first clock signal CLK1 provided from the timing controlling part 550, and outputs the gate signal GS to the gate line GL.

The first data driving part 600 is disposed at a first side of the data line DL. The first data driving part 600 receives the image data DATA from the timing controlling part 550, generates the data signal DS based on the image data DATA, and outputs the data signal DS to the first side of the data line DL in response to the horizontal start signal STH and the second clock signal CLK2 provided from the timing controlling part 550. The first data driving part 600 generates the data signal DS using the gamma voltage GMA provided from the gamma voltage outputting part 570. The first data driving part 600 may include a plurality of data driving integrated circuits 610, 620, 630 and 640 generating and outputting the data signal DS. For example, the data driving integrated circuits 610, 620, 630 and 640 may include a first data driving integrated circuit 610, a second data driving integrated circuit 620, a third data driving integrated circuit 630 and a fourth data driving integrated circuit 640.

The second data driving part 700 is disposed at a second side opposite to the first side of the data line DL. The second data driving part 700 receives the image data DATA from the timing controlling part 550, generates the data signal DS based on the image data DATA, and outputs the data signal DS to the second side of the data line DL in response to the horizontal start signal STH and the second clock signal CLK2 provided from the timing controlling part 550. The second data driving part 700 generates the data signal DS using the gamma voltage GMA provided from the gamma voltage outputting part 570. The second data driving part 700 includes a plurality of data driving integrated circuits 710, 720, 730 and 740 generating and outputting the data signal DS. For example, the data driving integrated circuits 710, 720, 730 and 740 include a fifth data driving integrated circuit 710, a sixth data driving integrated circuit 720, a seventh data driving integrated circuit 730 and an eighth data driving integrated circuit 740.

The timing controlling part 550 receives the image data DATA, and the control signal CON from an outside source. The control signal CON may include the horizontal synchronous signal Hsync, the vertical synchronous signal Vsync and the clock signal CLK. The timing controlling part 550 generates the horizontal start signal STH using the horizontal synchronous signal Hsync and outputs the horizontal start signal STH to the first data driving part 600 and the second data driving part 700. In addition, the timing controlling part 550 generates the vertical start signal STV using the vertical synchronous signal Vsync and outputs the vertical start signal STV to the gate driving part 130. In addition, the timing controlling part 550 generates the first clock signal CLK1 and the second clock signal CLK2 using the clock signal CLK, outputs the first clock signal CLK1 to the gate driving part 130, and outputs the second clock signal CLK2 to the first data driving part 600 and the second data driving part 700.

The gamma voltage outputting part 570 generates the gamma voltage GMA and outputs the gamma voltage GMA to the first data driving part 600 and the second data driving part 700.

Figure 9:
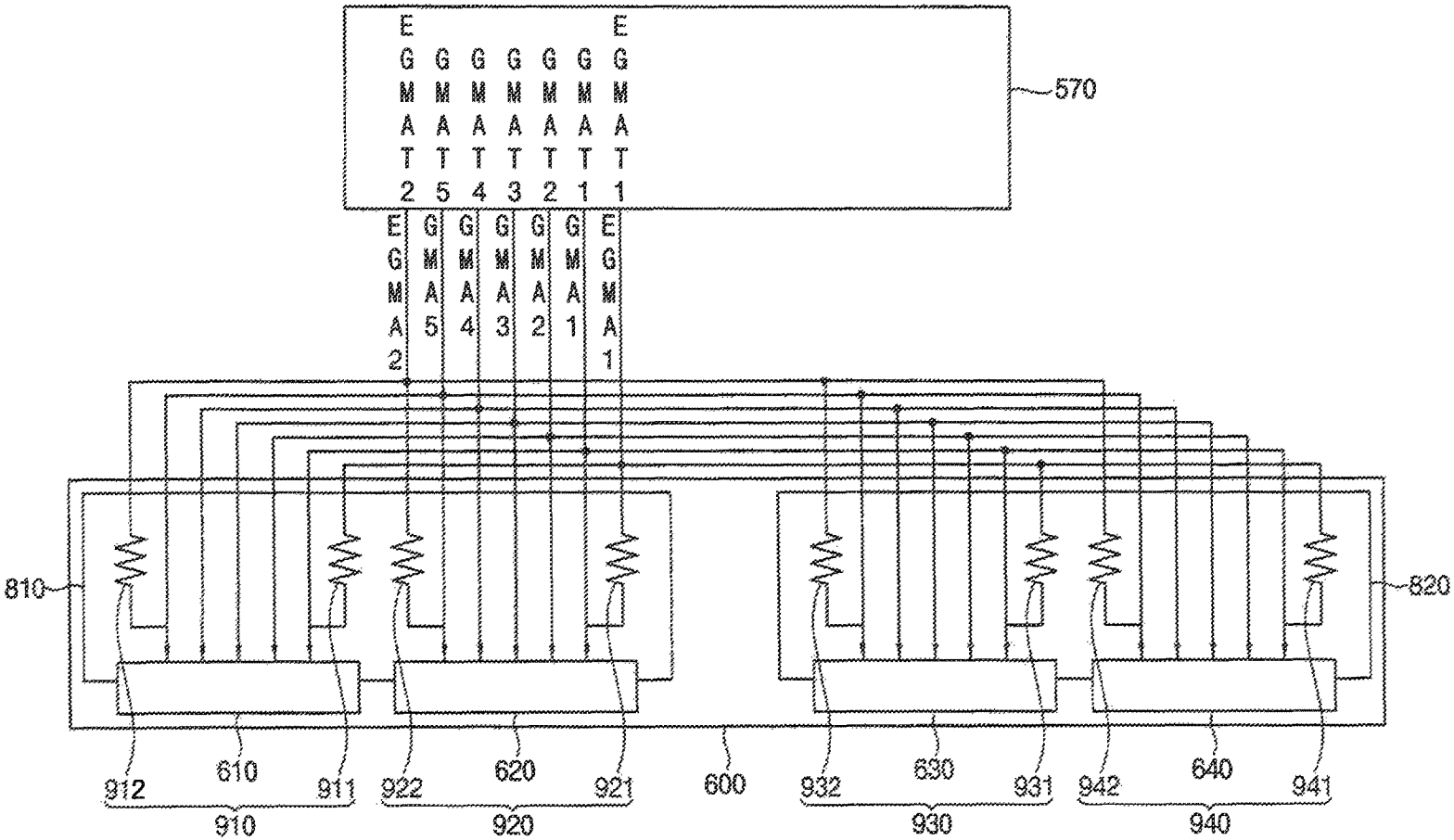
FIG. 9 is a block diagram illustrating a gamma voltage outputting part and a first data driving part in the display apparatus of FIG. 8.

FIG. 9 is a block diagram illustrating the gamma voltage outputting part 570 and the first data driving part 600 in the display apparatus 500 of FIG. 8.

Referring to FIGS. 8 and 9, the gamma voltage outputting part 570 outputs the gamma voltage GMA to the first data driving part 600. The gamma voltage GMA may include N (N is a natural number greater than two) gamma voltages. For example, the gamma voltage GMA may include the first gamma voltage GMA1, the second gamma voltage GMA2, the third gamma voltage GMA3, the fourth gamma voltage GMA4 and the fifth gamma voltage GMA5. Thus, the gamma voltage outputting part 570 may output the first gamma voltage GMA1, the second gamma voltage GMA2, the third gamma voltage GMA3, the fourth gamma voltage GMA4 and the fifth gamma voltage GMA5. Here, the fifth gamma voltage GMA5 may correspond to an N-th gamma voltage. The gamma voltage outputting part 570 may output the first gamma voltage GMA1, the second gamma voltage GMA2, the third gamma voltage GMA3, the fourth gamma voltage GMA4 and the fifth gamma voltage GMA5 to each of the first data driving integrated circuit 610, the second data driving integrated circuit 620, the third data driving integrated circuit 630 and the fourth data driving integrated circuit 640. The gamma voltage outputting part 570 may include a first gamma voltage output terminal GMAT1 outputting the first gamma voltage GMA1, a second gamma voltage output terminal GMAT2 outputting the second gamma voltage GMA2, a third gamma voltage output terminal GMAT3 outputting the third gamma voltage GMA3, a fourth gamma voltage output terminal GMAT4 outputting the fourth gamma voltage GMA4 and a fifth gamma voltage output terminal GMAT5 outputting the fifth gamma voltage GMA5.

In an embodiment, the first gamma voltage GMA1, the second gamma voltage GMA2, the third gamma voltage GMA3, the fourth gamma voltage GMA4 and the fifth gamma voltage GMA5 sequentially decrease. In an embodiment, the first gamma voltage GMA1, the second gamma voltage GMA2, the third gamma voltage GMA3, the fourth gamma voltage GMA4 and the fifth gamma voltage GMA5 linearly decrease.

The gamma voltage outputting part 570 further outputs the first extra gamma voltage EGMA1 and the second extra gamma voltage EGMA2. The first extra gamma voltage EGMA1 and the second extra gamma voltage EGMA2 are not directly applied to the first data driving integrated circuit 610, the second data driving integrated circuit 620, the third data driving integrated circuit 630 and the fourth data driving integrated circuit 640. In an exemplary embodiment, the first extra gamma voltage EGMA1 is greater than the first gamma voltage GMA1, and the second extra gamma voltage EGMA2 is less than the fifth gamma voltage GMA5.

In an embodiment, the first data driving part 600 includes a first data printed circuit board 810 and a second data printed circuit board 820. The first data driving integrated circuit 610 and the second data driving integrated circuit 620 may be disposed on the first data printed circuit board 810. The third data driving integrated circuit 630 and the fourth data driving integrated circuit 640 may be disposed on the second data printed circuit board 820.

The first data driving integrated circuit 610 receives the first gamma voltage GMA1, the second gamma voltage GMA2, the third gamma voltage GMA3, the fourth gamma voltage GMA4 and the fifth gamma voltage GMA5 from the gamma voltage outputting part 570. The first data driving integrated circuit 610 generates and outputs the data signal DS using the first gamma voltage GMA1, the second gamma voltage GMA2, the third gamma voltage GMA3, the fourth gamma voltage GMA4 and the fifth gamma voltage GMA5.

The second data driving integrated circuit 620 receives the first gamma voltage GMA1, the second gamma voltage GMA2, the third gamma voltage GMA3, the fourth gamma voltage GMA4 and the fifth gamma voltage GMA5 from the gamma voltage outputting part 570. The second data driving integrated circuit 620 generates and outputs the data signal DS using the first gamma voltage GMA1, the second gamma voltage GMA2, the third gamma voltage GMA3, the fourth gamma voltage GMA4 and the fifth gamma voltage GMA5.

The third data driving integrated circuit 630 receives the first gamma voltage GMA1, the second gamma voltage GMA2, the third gamma voltage GMA3, the fourth gamma voltage GMA4 and the fifth gamma voltage GMA5 from the gamma voltage outputting part 570. The third data driving integrated circuit 630 generates and outputs the data signal DS using the first gamma voltage GMA1, the second gamma voltage GMA2, the third gamma voltage GMA3, the fourth gamma voltage GMA4 and the fifth gamma voltage GMA5.

The fourth data driving integrated circuit 640 receives the first gamma voltage GMA1, the second gamma voltage GMA2, the third gamma voltage GMA3, the fourth gamma voltage GMA4 and the fifth gamma voltage GMA5 from the gamma voltage outputting part 570. The fourth data driving integrated circuit 640 generates and outputs the data signal DS using the first gamma voltage GMA1, the second gamma voltage GMA2, the third gamma voltage GMA3, the fourth gamma voltage GMA4 and the fifth gamma voltage GMA5.

The display apparatus 500 includes a first extra resistance part 910, a second extra resistance part 920, a third extra resistance part 930 and a fourth extra resistance part 940. The first extra resistance part 910, the second extra resistance part 920, the third extra resistance part 930 and the fourth extra resistance part 940 may be included in the display panel driving apparatus which drives the display panel 110.

The first extra resistance part 910 is electrically connected between the gamma voltage outputting part 570 and the first data driving integrated circuit 610. Specifically, the first extra resistance part 910 is electrically connected between the first and second extra gamma voltage output terminals EGMAT1 and EGMAT2 and the first data driving integrated circuit 610. The first extra resistance part 910 includes a first extra resistor 911 and a second extra resistor 912. The first extra resistor 911 is electrically connected between the first extra gamma voltage output terminal EGMAT1 and the first data driving integrated circuit 610. The second extra resistor 912 is electrically connected between the second extra gamma voltage output terminal EGMAT2 and the first data driving integrated circuit 610.

The second extra resistance part 920 is electrically connected between the gamma voltage outputting part 570 and the second data driving integrated circuit 620. Specifically, the second extra resistance part 920 is electrically connected between the first and second extra gamma voltage output terminals EGMAT1 and EGAMT2 and the second data driving integrated circuit 620. The second extra resistance part 920 includes a third extra resistor 921 and a fourth extra resistor 922. The third extra resistor 921 is electrically connected between the first extra gamma voltage output terminal EGMAT1 and the second data driving integrated circuit 620. The fourth extra resistor 922 is electrically connected between the second extra gamma voltage output terminal EGMAT2 and the second data driving integrated circuit 620.

The third extra resistance part 930 is electrically connected between the gamma voltage outputting part 570 and the third data driving integrated circuit 630. Specifically, the third extra resistance part 930 is electrically connected between the first and second extra gamma voltage output terminals EGMAT1 and EGMAT2 and the third data driving integrated circuit 630. The third extra resistance part 930 includes a fifth extra resistor 931 and a sixth extra resistor 932. The fifth extra resistor 931 is electrically connected between the first extra gamma voltage output terminal EGMAT1 and the third data driving integrated circuit 630. The sixth extra resistor 932 is electrically connected between the second extra gamma voltage output terminal EGMAT2 and the third data driving integrated circuit 630.

The fourth extra resistance part 940 is electrically connected between the gamma voltage outputting part 570 and the fourth data driving integrated circuit 640. Specifically, the fourth extra resistance part 940 is electrically connected between the first and second extra gamma voltage output terminals EGMAT1 and EGMAT2 and the fourth data driving integrated circuit 640. The fourth extra resistance part 940 includes a seventh extra resistor 941 and an eighth extra resistor 942. The seventh extra resistor 941 is electrically connected between the first extra gamma voltage output terminal EGMAT1 and the fourth data driving integrated circuit 640. The eighth extra resistor 942 is electrically connected between the second extra gamma voltage output terminal EGMAT2 and the fourth data driving integrated circuit 640.

Configurations and connections of the gamma voltage outputting part 570, the first data driving integrated circuit 610 and the first extra resistance part 910 are substantially the same as configurations and connections of the gamma voltage outputting part 170, the first data driving integrated circuit 210 and the first extra resistance part 410 of FIG. 4.

In addition, configurations and connections of the gamma voltage outputting part 570, the second data driving integrated circuit 620 and the second extra resistance part 920 are substantially the same as configurations and connections of the gamma voltage outputting part 170, the second data driving integrated circuit 220 and the second extra resistance part 420 of FIG. 5.

In addition, configurations and connections of the gamma voltage outputting part 570, the third data driving integrated circuit 630 and the third extra resistance part 930 are substantially the same as configurations and connections of the gamma voltage outputting part 170, the third data driving integrated circuit 230 and the third extra resistance part 430 of FIG. 6.

In addition, configurations and connections of the gamma voltage outputting part 570, the fourth data driving integrated circuit 640 and the fourth extra resistance part 940 are substantially the same as configurations and connections of the gamma voltage outputting part 170, the fourth data driving integrated circuit 240 and the fourth extra resistance part 440 of FIG. 7.

Figure 10:
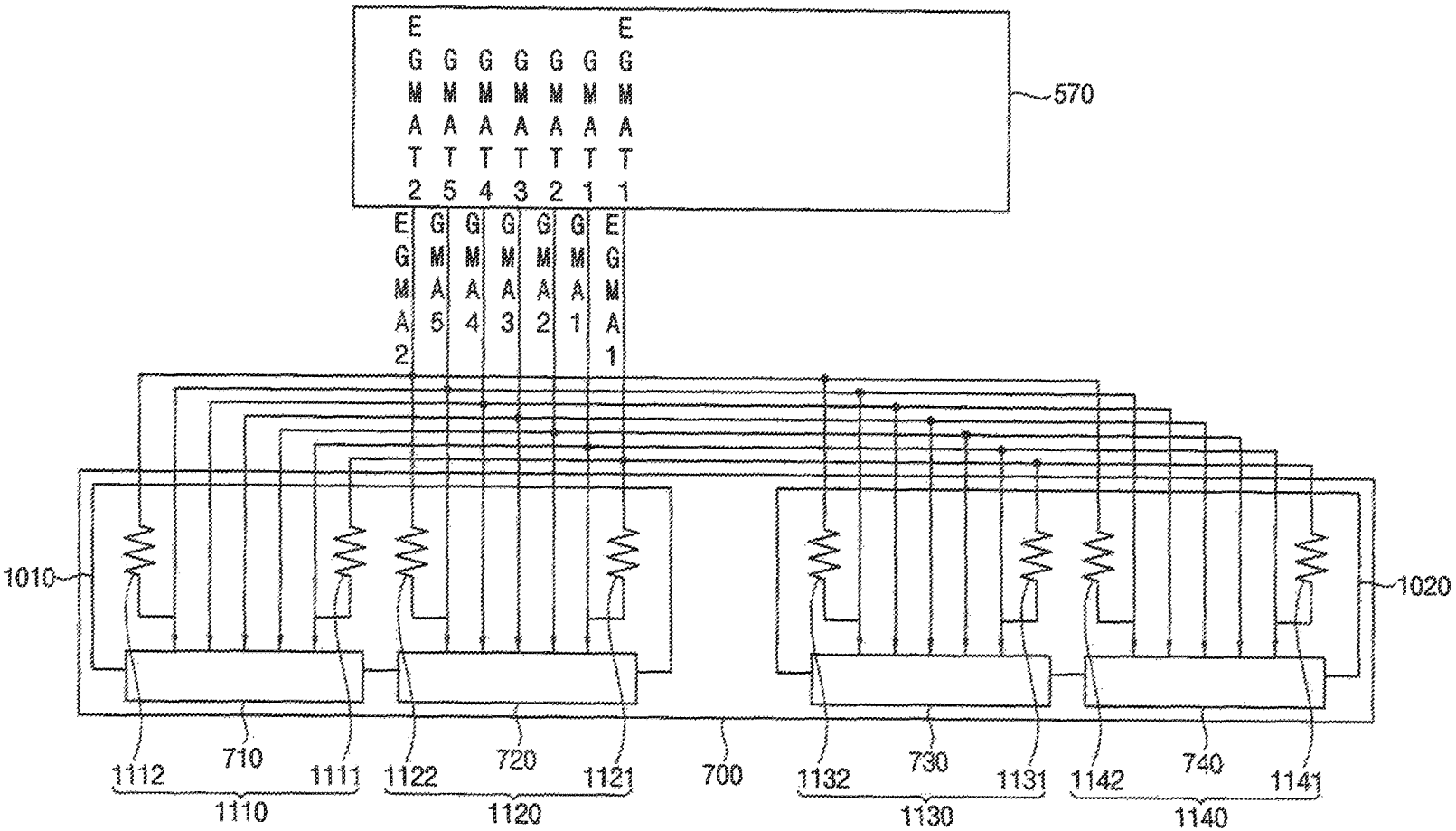
FIG. 10 is a block diagram illustrating the gamma voltage outputting part and a second data driving part in the display apparatus of FIG. 8.

FIG. 10 is a block diagram illustrating the gamma voltage outputting part 570 and the second data driving part 700 in the display apparatus 500 of FIG. 8.

Referring to FIGS. 8 and 10, the gamma voltage outputting part 570 outputs the gamma voltage GMA to the second data driving part 700. The gamma voltage outputting part 570 may output the first gamma voltage GMA1, the second gamma voltage GMA2, the third gamma voltage GMA3, the fourth gamma voltage GMA4 and the fifth gamma voltage GMA5 to each of the fifth data driving integrated circuit 710, the sixth data driving integrated circuit 720, the seventh data driving integrated circuit 730 and the eighth data driving integrated circuit 740.

The first extra gamma voltage EGMA1 and the second extra gamma voltage EGMA2 are not directly applied to the fifth data driving integrated circuit 710, the sixth data driving integrated circuit 720, the seventh data driving integrated circuit 730 and the eighth data driving integrated circuit 740.

In an embodiment, the second data driving part 700 includes a third data printed circuit board 1010 and a fourth data printed circuit board 1020. The fifth data driving integrated circuit 710 and the sixth data driving integrated circuit 720 may be disposed on the third data printed circuit board 1010. The seventh data driving integrated circuit 730 and the eighth data driving integrated circuit 740 may be disposed on the fourth data printed circuit board 1020.

The fifth data driving integrated circuit 710 receives the first gamma voltage GMA1, the second gamma voltage GMA2, the third gamma voltage GMA3, the fourth gamma voltage GMA4 and the fifth gamma voltage GMA5 from the gamma voltage outputting part 570. The fifth data driving integrated circuit 710 generates and outputs the data signal DS using the first gamma voltage GMA1, the second gamma voltage GMA2, the third gamma voltage GMA3, the fourth gamma voltage GMA4 and the fifth gamma voltage GMA5.

The sixth data driving integrated circuit 720 receives the first gamma voltage GMA1, the second gamma voltage GMA2, the third gamma voltage GMA3, the fourth gamma voltage GMA4 and the fifth gamma voltage GMA5 from the gamma voltage outputting part 570. The sixth data driving integrated circuit 720 generates and outputs the data signal DS using the first gamma voltage GMA1, the second gamma voltage GMA2, the third gamma voltage GMA3, the fourth gamma voltage GMA4 and the fifth gamma voltage GMA5.

The seventh data driving integrated circuit 730 receives the first gamma voltage GMA1, the second gamma voltage GMA2, the third gamma voltage GMA3, the fourth gamma voltage GMA4 and the fifth gamma voltage GMA5 from the gamma voltage outputting part 570. The seventh data driving integrated circuit 730 generates and outputs the data signal DS using the first gamma voltage GMA1, the second gamma voltage GMA2, the third gamma voltage GMA3, the fourth gamma voltage GMA4 and the fifth gamma voltage GMA5.

The eighth data driving integrated circuit 740 receives the first gamma voltage GMA1, the second gamma voltage GMA2, the third gamma voltage GMA3, the fourth gamma voltage GMA4 and the fifth gamma voltage GMA5 from the gamma voltage outputting part 570. The eighth data driving integrated circuit 740 generates and outputs the data signal DS using the first gamma voltage GMA1, the second gamma voltage GMA2, the third gamma voltage GMA3, the fourth gamma voltage GMA4 and the fifth gamma voltage GMA5.

The display apparatus 500 includes a fifth extra resistance part 1110, a sixth extra resistance part 1120, a seventh extra resistance part 1130 and an eighth extra resistance part 1140. The fifth extra resistance part 1110, the sixth extra resistance part 1120, the seventh extra resistance part 1130 and the eighth extra resistance part 1140 may be included in the display panel driving apparatus which drives the display panel 110.

The fifth extra resistance part 1110 is electrically connected between the gamma voltage outputting part 570 and the fifth data driving integrated circuit 710. Specifically, the fifth extra resistance part 1110 is electrically connected between the first and second extra gamma voltage output terminals EGMAT1 and EGMAT2 and the fifth data driving integrated circuit 710. The fifth extra resistance part 1110 includes a ninth extra resistor 1111 and a tenth extra resistor 1112. The ninth extra resistor 1111 is electrically connected between the first extra gamma voltage output terminal EGMAT1 and the fifth data driving integrated circuit 710. The tenth extra resistor 1112 is electrically connected between the second extra gamma voltage output terminal EGMAT2 and the fifth data driving integrated circuit 710.

The sixth extra resistance part 1120 is electrically connected between the gamma voltage outputting part 570 and the sixth data driving integrated circuit 720. Specifically, the sixth extra resistance part 1120 is electrically connected between the first and second extra gamma voltage output terminals EGMAT1 and EGMAT2 and the sixth data driving integrated circuit 720. The sixth extra resistance part 1120 includes an eleventh extra resistor 1121 and a twelfth extra resistor 1122. The eleventh extra resistor 1121 is electrically connected between the first extra gamma voltage output terminal EGMAT1 and the sixth data driving integrated circuit 720. The twelfth extra resistor 1122 is electrically connected between the second extra gamma voltage output terminal EGMAT2 and the sixth data driving integrated circuit 720.

The seventh extra resistance part 1130 is electrically connected between the gamma voltage outputting part 570 and the seventh data driving integrated circuit 730. Specifically, the seventh extra resistance part 1130 is electrically connected between the first and second extra gamma voltage output terminals EGMAT1 and EGMAT2 and the seventh data driving integrated circuit 730. The seventh extra resistance part 1130 includes a thirteenth extra resistor 1131 and a fourteenth extra resistor 1132. The thirteenth extra resistor 1131 is electrically connected between the first extra gamma voltage output terminal EGMAT1 and the seventh data driving integrated circuit 730. The fourteenth extra resistor 1132 is electrically connected between the second extra gamma voltage output terminal EGMAT2 and the seventh data driving integrated circuit 730.

The eighth extra resistance part 1140 is electrically connected between the gamma voltage outputting part 570 and the eighth data driving integrated circuit 740. Specifically, the eighth extra resistance part 1140 is electrically connected between the first and second extra gamma voltage output terminals EGMAT1 and EGMAT2 and the eighth data driving integrated circuit 740. The eighth extra resistance part 1140 includes a fifteenth extra resistor 1141 and a sixteenth extra resistor 1142. The fifteenth extra resistor 1141 is electrically connected between the first extra gamma voltage output terminal EGMAT1 and the eighth data driving integrated circuit 740. The sixteenth extra resistor 1142 is electrically connected between the second extra gamma voltage output terminal EGMAT2 and the eighth data driving integrated circuit 740.

Configurations and connections of the gamma voltage outputting part 570, the fifth data driving integrated circuit 710 and the fifth extra resistance part 1110 are substantially the same as the configurations and connections of the gamma voltage outputting part 170, the first data driving integrated circuit 210 and the first extra resistance part 410 of FIG. 4.

In addition, configurations and connections of the gamma voltage outputting part 570, the sixth data driving integrated circuit 720 and the sixth extra resistance part 1120 are substantially the same as the configurations and connections of the gamma voltage outputting part 170, the second data driving integrated circuit 220 and the second extra resistance part 420 of FIG. 5.

In addition, configurations and connections of the gamma voltage outputting part 570, the seventh data driving integrated circuit 730 and the seventh extra resistance part 1130 are substantially the same as the configurations and connections of the gamma voltage outputting part 170, the third data driving integrated circuit 230 and the third extra resistance part 430 of FIG. 6.

In addition, configurations and connections of the gamma voltage outputting part 570, the eighth data driving integrated circuit 740 and the eighth extra resistance part 1140 are substantially the same as configurations and connections of the gamma voltage outputting part 170, the fourth data driving integrated circuit 240 and the fourth extra resistance part 440 of FIG. 7.

According to the present exemplary embodiment, a constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the first data driving integrated circuit 610 may decrease. In addition, a constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the second data driving integrated circuit 620 may decrease. In addition, a constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the third data driving integrated circuit 630 may decrease. In addition, a constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the fourth data driving integrated circuit 640 may decrease. In addition, a constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the fifth data driving integrated circuit 710 may decrease. In addition, a constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the sixth data driving integrated circuit 720 may decrease. In addition, a constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the seventh data driving integrated circuit 730 may decrease. In addition, a constant current between the first to fifth gamma voltage output terminals GMAT1, GMAT2, GMAT3, GMAT4 and GMAT5 respectively outputting the first to fifth gamma voltages GMA1, GMA2, GMA3, GMA4 and GMA5 and the eighth data driving integrated circuit 740 may decrease.

Therefore, a current-resistance drop and rise (i.e., IR drop and rise) between the gamma voltage outputting part 570 and the first data printed circuit board 810 may be removed. In addition, a current-resistance drop and rise (i.e., IR drop and rise) between the gamma voltage outputting part 570 and the second data printed circuit board 820 may be removed. In addition, a current-resistance drop and rise (i.e., IR drop and rise) between the gamma voltage outputting part 570 and the third data printed circuit board 1010 may be removed. In addition, a current-resistance drop and rise (i.e., IR drop and rise) between the gamma voltage outputting part 570 and the fourth data printed circuit board 1020 may be removed.

Thus, a color difference among an area of the display panel 110 receiving the data signal DS output from the first data driving integrated circuit 610 and the second data driving integrated circuit 620 which are disposed on the first data printed circuit board 810, an area of the display panel 110 receiving the data signal DS output from the third data driving integrated circuit 630 and the fourth data driving integrated circuit 640 which are disposed on the second data printed circuit board 820, an area of the display panel 110 receiving the data signal DS output from the fifth data driving integrated circuit 710 and the sixth data driving integrated circuit 720 which are disposed on the third data printed circuit board 1010, and an area of the display panel 110 receiving the data signal DS output from the seventh data driving integrated circuit 730 and the eighth data driving integrated circuit 740 which are disposed on the fourth data printed circuit board 1020 may be decreased. Accordingly, display quality of the display apparatus 500 may be improved.

The present inventive concept may be applied to an electronic device having a display apparatus. For example, the present inventive concept may be applied to a television, a computer monitor, a laptop, a digital camera, a cellular phone, a smart phone, a tablet Personal Computer (PC), a smart pad, a Personal Digital Assistant (PDA), a Portable Multimedia Player (PMP), an MP3 player, a navigation system, a camcorder, a portable game console, etc.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept.

What is claimed is:

1. A display panel driving apparatus comprising:

a data driver configured to generate a data signal based on at least one of first to N-th gamma voltages and output the data signal to a data line of a display panel;

a gate driver configured to output a gate signal to a gate line of the display panel;

an extra resistance part through which a constant current passes; and a circuit configured to generate the first to N-th gamma voltages, and output a first extra gamma voltage indirectly to the data driver through the extra resistance part; and a plurality of signals lines providing a corresponding one of the first to N-th gamma voltages from the circuit to the data driver, wherein the extra resistance part comprises a first extra resistor electrically connected between the circuit and a first one of the signal lines, and a second extra resistor electrically connected between the circuit and a last one of the signal lines, wherein the data driver comprises a resistor string including a plurality of resistors receiving the first to Nth gamma voltages, wherein the resistor string is disposed in a data driving integrated circuit, and wherein the extra resistors are located outside the circuit and outside the data driving integrated circuit.

2. The display panel driving apparatus of claim 1, wherein the circuit outputs the first to N-th gamma voltages directly to the data driver, and a second extra gamma voltage indirectly to the data driver, where N is a natural number greater than or equal to two.

3. The display panel driving apparatus of claim 2, wherein the first to N-th gamma voltages sequentially decrease.

4. The display panel driving apparatus of claim 3, wherein the first to N-th gamma voltages linearly decrease.

5. The display panel driving apparatus of claim 4, wherein the first extra gamma voltage is greater than the first gamma voltage.

6. The display panel driving apparatus of claim 4, wherein the second extra gamma voltage is less than the N-th gamma voltage.

7. The display panel driving apparatus of claim 2, wherein the first extra resistor is electrically connected between a first extra gamma voltage output terminal outputting the first extra gamma voltage, and a first gamma voltage output terminal outputting the first gamma voltage: and wherein the second extra resistor is electrically connected between a second extra gamma voltage output terminal outputting the second extra gamma voltage, and an N-th gamma voltage output terminal outputting the N-th gamma voltage.

8. The display panel driving apparatus of claim 7, wherein the data driver comprises a resistor string including a plurality of resistors receiving the first to N-th gamma voltages.

9. The display panel driving apparatus of claim 8, wherein the constant current sequentially passes through the first extra gamma voltage output terminal, the first extra resistor, the resistor string, the second extra resistor and the second extra gamma voltage output terminal.

10. The display panel driving apparatus of claim 8, wherein resistances of each of the resistors included in the resistor string are the same.

11. The display panel driving apparatus of claim 10, wherein the first extra gamma voltage is calculated by EGMA1=GMA1+(GMA1−GMAN)/(N−1)*(PR1+ER1)/R, wherein EGMA1 is the first extra gamma voltage, GMA1 is the first gamma voltage, GMAN is the N-th gamma voltage, N is the number of the gamma voltages, PR1 is a resistance of a first path resistor between the first extra gamma voltage output terminal and the first extra resistor, ER1 is a resistance of the first extra resistor, and R is a resistance of one among the resistors in the resistor string.

12. The display panel driving apparatus of claim 10, wherein the second extra gamma voltage is calculated by EGMA2=GMAN−(GMAT−GMAN)/(N−1)*(PR2+ER2)/R, wherein EGMA2 is the second extra gamma voltage, GMA1 is the first gamma voltage, GMAN is the N-th gamma voltage, N is the number of the gamma voltages, PR2 is a resistance of a second path resistor between the second extra gamma voltage output terminal and the second extra resistor, ER2 is a resistance of the second extra resistor, and R is a resistance of one among resistors in the resistor string.

13. The display panel driving apparatus of claim 8, wherein a resistance of the first extra resistor, a resistance of the second extra resistor, and resistances of each of the resistors in the resistor string are the same.

14. The display panel driving apparatus of claim 2, wherein the first and second extra gamma voltages are each generated from a first gamma voltage output through the first signal line and from the N-th gamma voltage output through the last signal line.

15. The display panel driving apparatus of claim 1, wherein the data driver comprises:

a first data driving circuit adjacent to one side of the data line and configured to output the data signal to the one side of the data line; and a second data driving circuit adjacent to another side opposite to the one side of the data line and configured to output the data signal to the another side of the data line.

16. A display apparatus comprising:

a display pan& configured to display an image; and the display panel driving apparatus of claim 1.

* * * * *